US007670154B2

(12) United States Patent
Yu et al.

(10) Patent No.: US 7,670,154 B2
(45) Date of Patent: Mar. 2, 2010

(54) SOLDERNESS CABLE ASSEMBLY

(75) Inventors: Ya-Fei Yu, ShenZhen (CN); Xian-Kui Shi, ShenZhen (CN); Kevin Gao, ShenZhen (CN); Chung-Yen Yang, Tu-Cheng (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/322,500

(22) Filed: Feb. 2, 2009

(65) Prior Publication Data

US 2009/0197468 A1 Aug. 6, 2009

(30) Foreign Application Priority Data

Feb. 1, 2008 (CN) ..... 2008 2 0031472 U

(51) Int. Cl.
*H01R 9/05* (2006.01)

(52) U.S. Cl. ..... 439/98; 439/579

(58) Field of Classification Search ..... 439/98, 439/579, 607.41–607.5, 585
See application file for complete search history.

(56) References Cited

U.S. PATENT DOCUMENTS 5,785,555 A * 7/1998 O'Sullivan et al. ..... 439/579
7,052,292 B2 * 5/2006 Hsu et al. ..... 439/98
7,214,097 B1 * 5/2007 Hsu et al. ..... 439/607.47
2006/0246776 A1 * 11/2006 Itou et al. ..... 439/579

* cited by examiner

*Primary Examiner*—Gary F. Paumen
(74) *Attorney, Agent, or Firm*—Wei Te Chung; Andrew C. Cheng; Ming Chieh Chang

(57) ABSTRACT

An cable assembly (100) includes an insulated housing (1) defining a plurality of contact slots; a plurality of contacts (2) accommodated in the contact slots, with tail portions thereof disposed outside of the insulated housing; at least a cable (4) including two wires (41) enclosed within a conductive shielding portion (43); a grounding member (3) including a main portion (31), a finger portion (33) extending forwardly from the main portion and a connecting portion (32) formed at a rear segment of the main portion, said connecting portion gripping outside of the conductive shielding portion of the cable; and the finger portion and inner conductors of the wires clamped by the tail portions of the contacts.

15 Claims, 7 Drawing Sheets

SOLDERNESS CABLE ASSEMBLY

FIELD OF THE INVENTION

The present invention generally relates to a cable assembly, and more particularly to a cable assembly with contact members and a cable thereof electrically and mechanically connected together without soldering process.

DESCRIPTION OF PRIOR ART

Serial Advanced Technology Attachment (SATA) is an art that is different from Advanced Technology Attachment (PATA). At present, transmitting rate of an device utilizing SATA has already up to 150 MB/s or more, which is much higher than an equipment adopting PATA.

A SATA cable assembly is used for connecting a Hard Disk (HD) and a main board (MB) of a computer. The SATA cable assembly used for transmitting signals includes a connector and a cable connected thereto. The connector has two pair of signal contacts spaced apart by three grounding contacts. The cable also has two pair of wires coupled to the corresponding signal contacts. Each of the pair of wires is further shielded by conductive portions for coupled to the grounding contacts. The wires and the grounding portions both mechanically and electrically connected to the signal contacts and the grounding contacts via soldering process. However, soldering process may cause some environmental pollution problems. Hence, a new method for terminating the connector and the cable is desired.

SUMMARY OF THE INVENTION

Accordingly, an object of the present invention is to provide a cable assembly with a connector and a corresponding cable interconnected one another with a mechanical method, rather than a soldering process.

In order to achieve the object set forth, a cable assembly in accordance with the present invention comprises an insulated housing defining a plurality of contact slots; a plurality of contacts accommodated in the contact slots, with tail portions thereof disposed outside of the insulated housing; at least a cable including two wires enclosed within a conductive shielding portion; a grounding member including a main portion, a finger portion extending forwardly from the main portion and a connecting portion formed at a rear segment of the main portion, said connecting portion gripping outside of the conductive shielding portion of the cable; and the finger portion and inner conductors of the wires clamped by the tail portions of the contacts.

Other objects, advantages and novel features of the invention will become more apparent from the following detailed description when taken in conjunction with the accompanying drawings.

DETAILED DESCRIPTION OF PREFERRED EMBODIMENTS

Figure 1:
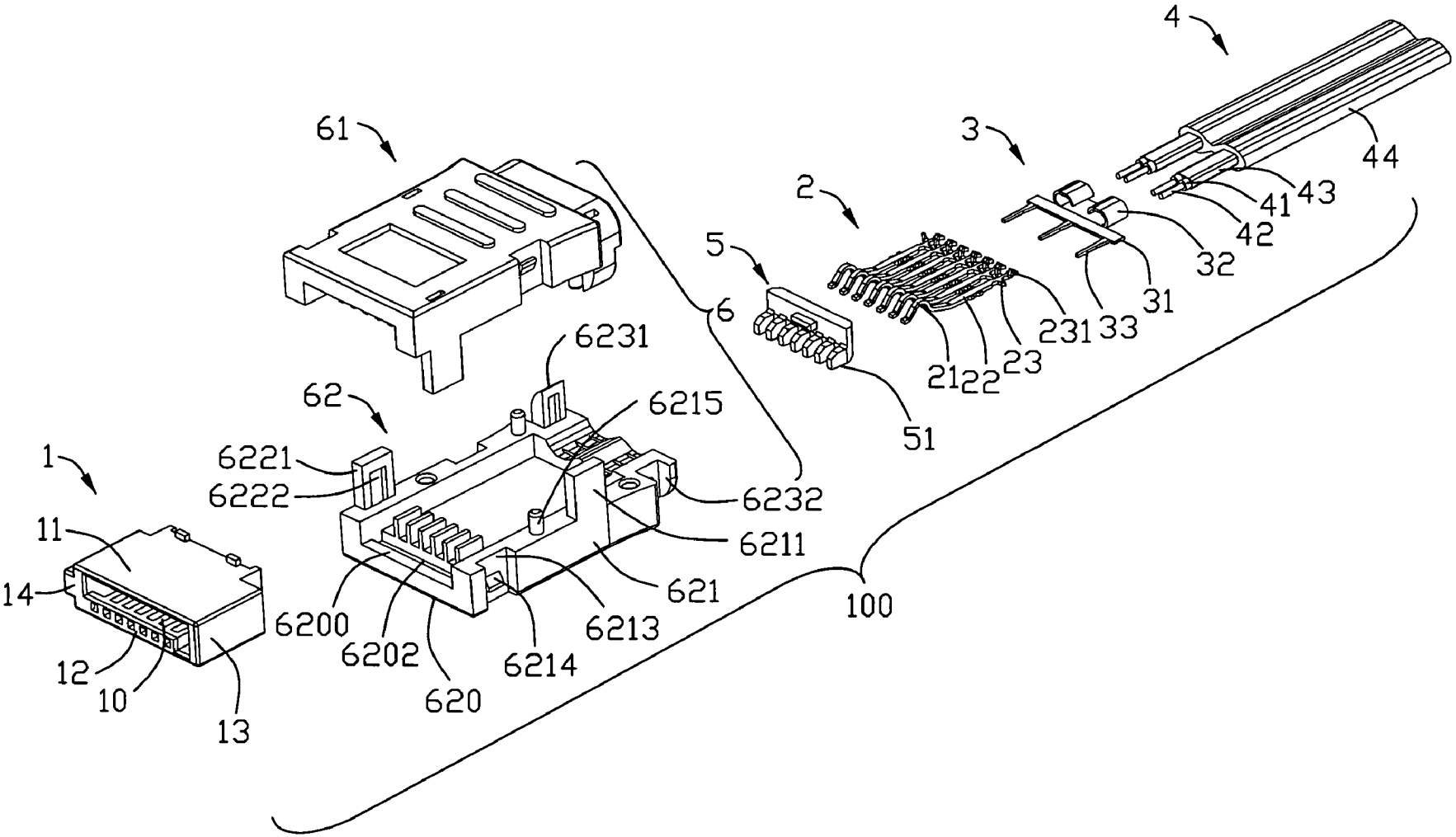
FIG. 1 is an exploded, perspective view of a cable assembly of a first embodiment in accordance with the present invention.
Figure 2:
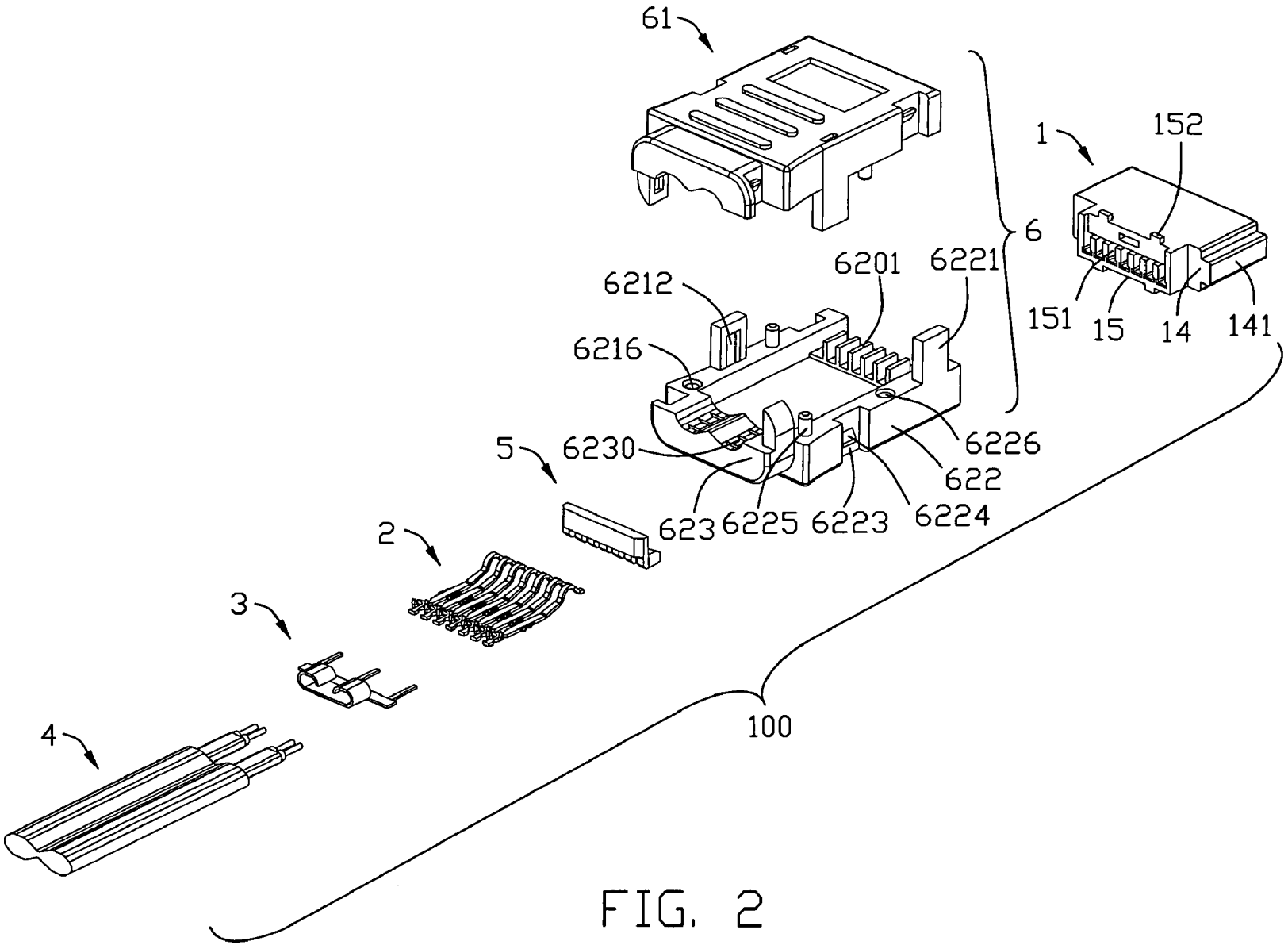
FIG. 2 is similar to FIG. 1, but viewed from other aspect.
Figure 3:
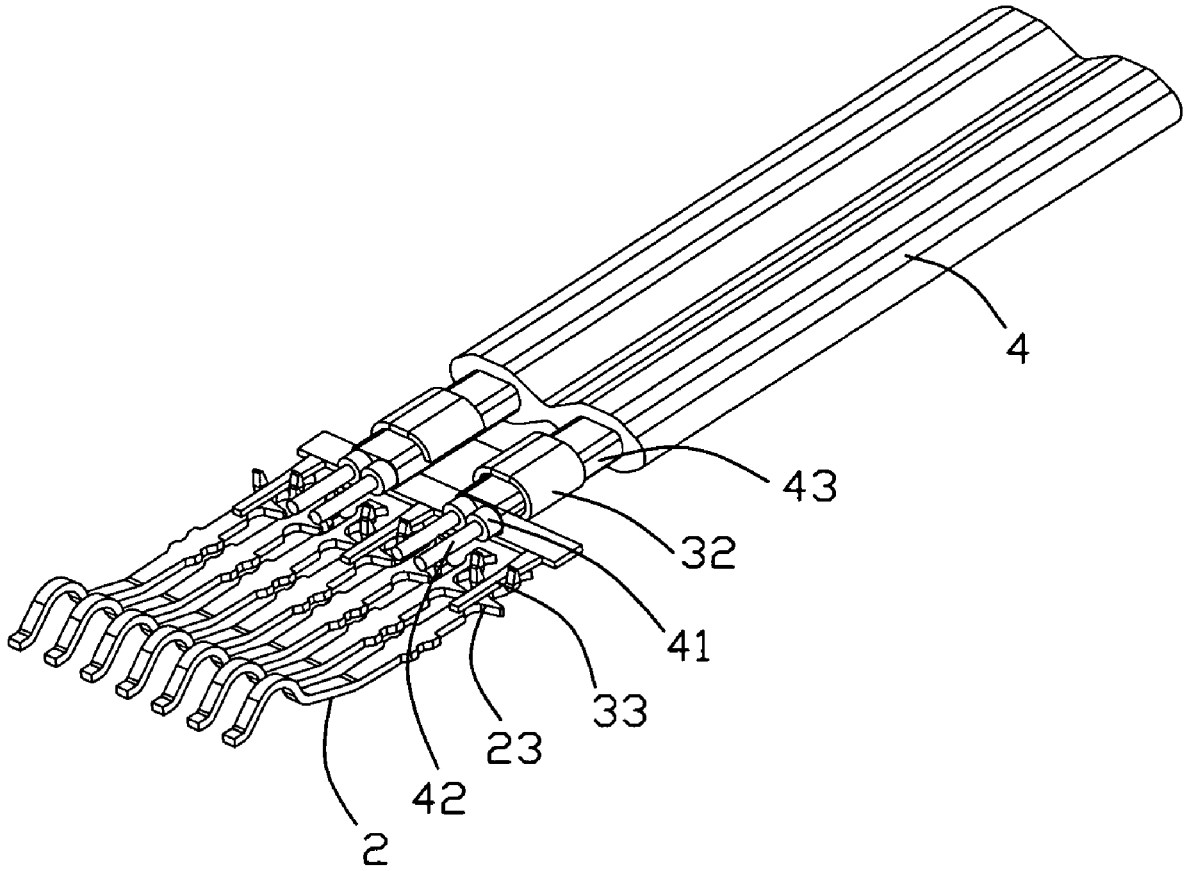
FIG. 3 illustrates interconnection relations between cables and contacts.
Figure 4:
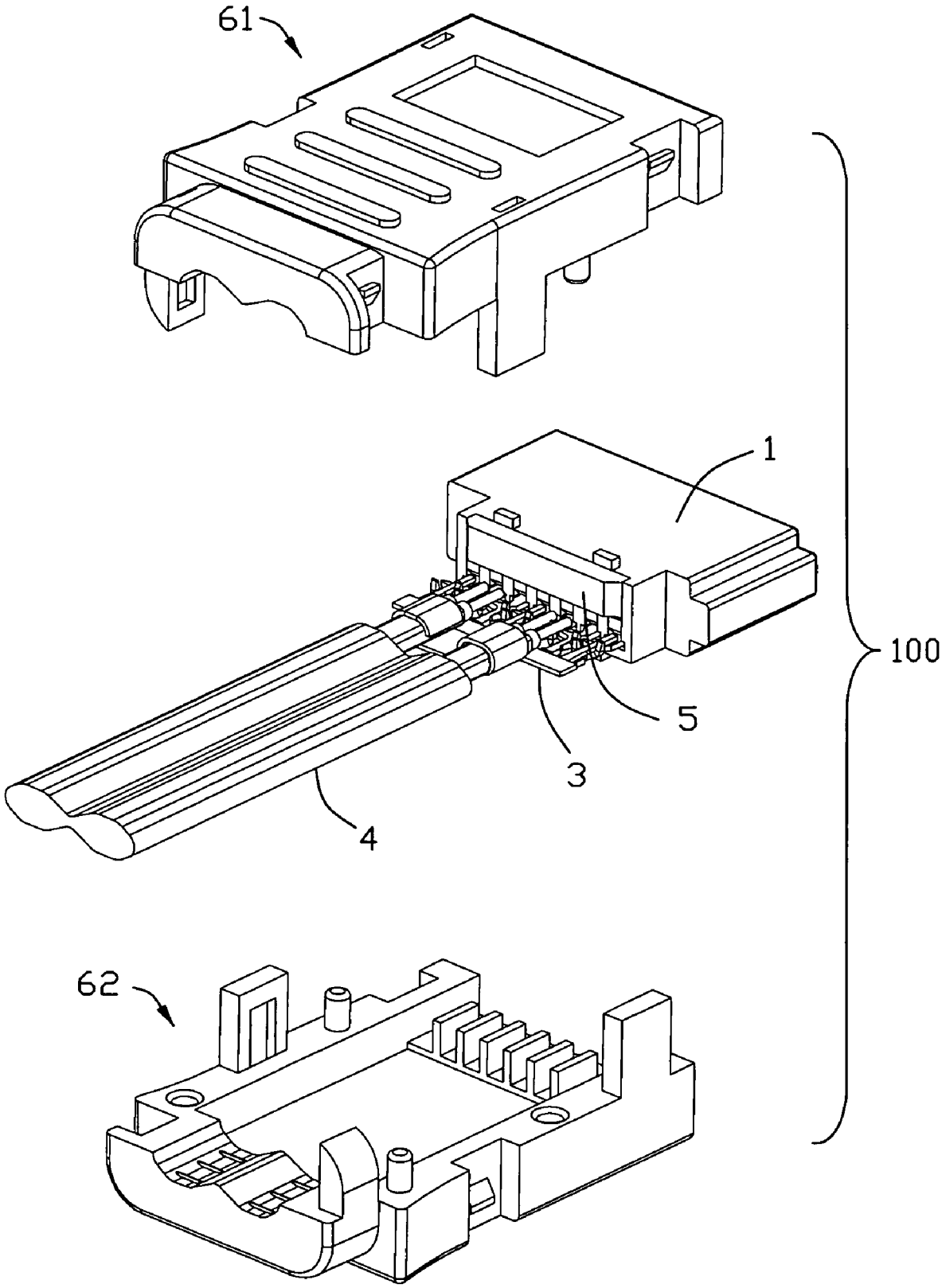
FIG. 4 is a partially assembled perspective view of the cable assembly.
Figure 5:
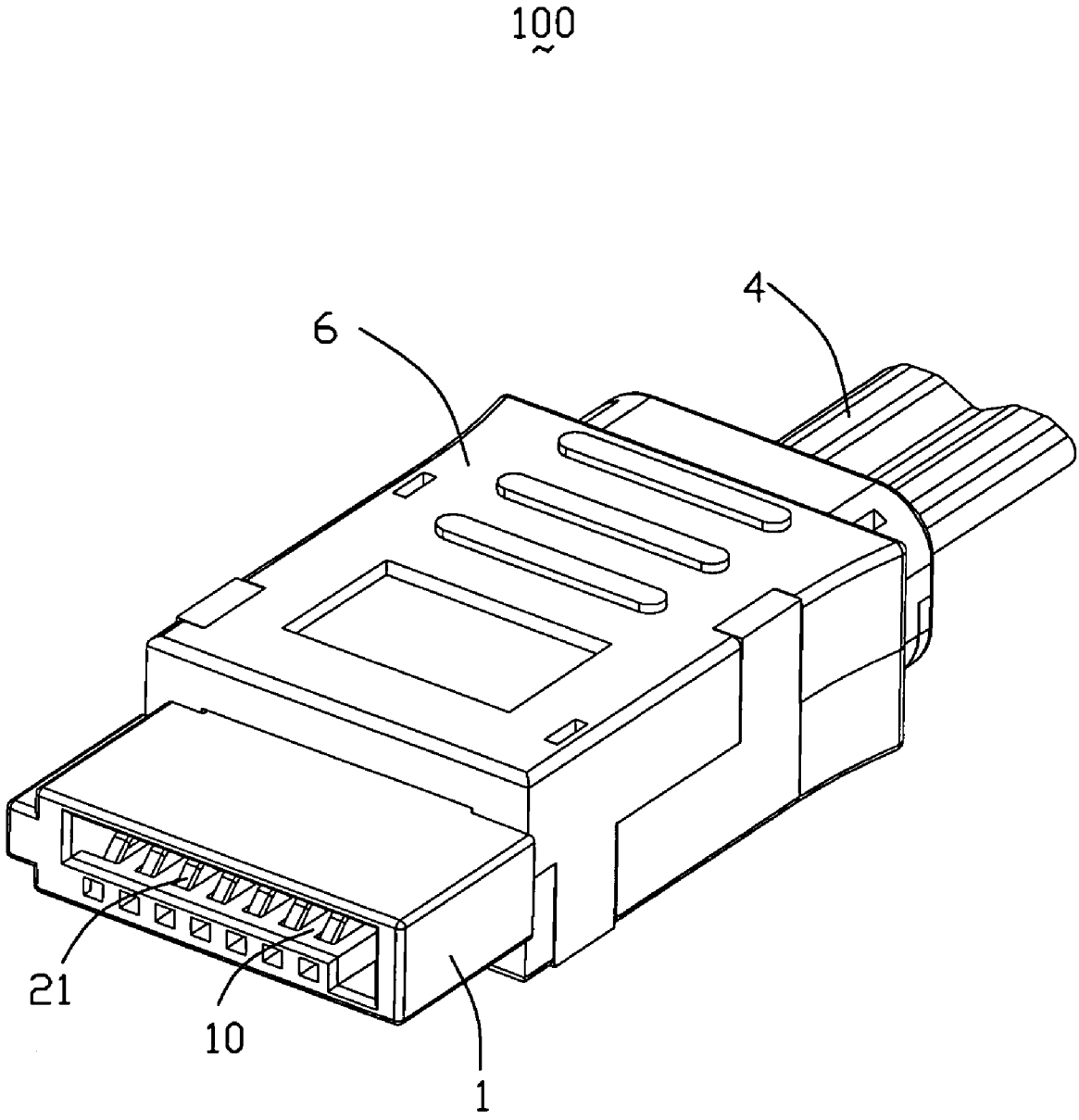
FIG. 5 is an assembled, perspective view of the cable assembly.

Reference will now be made in detail to the preferred embodiment of the present invention.

Referring to FIGS. 1-5, a cable assembly 100 of a first embodiment in accordance to the present invention comprises an insulated housing 1, a number of contacts 2, a grounding member 3, a cable 4, a spacer 5 and a cover 6

The insulated housing 1 includes an upper wall 11, a bottom wall 12, a pair of side walls 13, 14 interconnecting the upper and bottom walls 11, 12 to together define an L-shaped mating port 10. A number of contact slots 151 are recessed forwardly from a back wall 15 of the insulated housing 1 and in communication to the mating port 10. A guiding member 141 is formed on an outer surface of the side wall 14. Two pairs of protrusion members 152 are respectively arranged on the top and low surface of the back wall 15.

The contacts 2 has seven contact members which are arranged in a row along a transversal direction. The contact members includes three grounding contacts and two pairs of signal contacts located between the grounding contacts. That is to say, the first, fourth and seventh positions of the row are grounding contacts, and the rest positions of the row are signal contacts. Each of the contacts 2 has a body portion 22 retained in the corresponding contact slot 151, a mating portion 21 extending into the mating port 10, and a tail portion 23 extending beyond the back wall 15. A number of tooth-shaped protrusion members 231 are alternatively arranged at two lateral sides of the tail portion 23.

The cable 4 includes two differential pairs 41 arranged in juxtaposed manner and each differential pairs 41 having two conductors 42 insulated from one another, conductive shielding portions 43 respectively covering the differential pairs 41 and a jacket enclosing the shielding portions 43. The conductive shielding portion 43 may be aluminum foil or copper foil.

The grounding member 3 is made of metallic sheet and comprises a main portion 31, three finger portions 33 spaced apart each other and projected forwardly from the main portion 31, two connecting portions 32 torn apart and crimped from lateral sides of a rear segment of the main portion 31. The connecting portions 32 grip/clamp the conductive shielding portions 43, the finger portions 33 are supported by the tail portions 23 of the grounding contacts, while the inner conductors 42 of the two differential pairs 41 are located on the tail portions 23 of the signal contacts, then the protrusion members 231 are bent to clip/clamp the finger portions 33 and the inner conductors to have the cable 4 and the contacts 2 mechanically and electrically combined together.

A spacer member 5 is assembled to the back wall 15 of the insulated housing 1, with a number of protruding members 51 thereon projected into the contacts slots 151.

The cable assembly 100 further comprises a cover 6 enclosing a rear portion of the insulated housing 1 and a partial of the cable 4 adjacent to the insulated housing 1. The cover 6 includes a first part (upper part) 61 and a second part (lower part) 62 associated with the first part 61.

The second part 62 includes a bottom wall 620, a pair of right and left walls 621, 622 extending upwardly from lateral sides of the bottom wall 620, and a back wall 623 connected to the bottom wall 620 and the pair of right and left walls 621, 622. Both the right and left walls 621, 622 have a first clasping portion 6211, 6221 offset from one another. The first clasping portions 6211, 6221 further define positioning cavities 6212, 6222 in inner sides thereof. Two first locating cavities 6213, 6223 are defined in the right and left walls 621, 622. Two tabs 6214, 6224 are respectively arranged in the first locating cavities 6213, 6223. A pair of positioning posts 6215, 6225 project upwardly from top surfaces of the right and left walls 621, 622. The pair of positioning posts 6215, 6225 also offset one another. Two positioning holes 6216, 6226 are recessed downwardly from the top surfaces of the right and left walls 621, 622. A supporter member 6200 is arranged on a front segment of the bottom wall and located between the right and left walls 621, 622. A slot 6202 is recessed downwardly from a middle section of the supporter member 6200. A number of ribs 6201 are spaced apart each other and located on a back section of the supporter member 6200. A second clasping portion 6231 is formed on a left side of the back wall 623 and a second locating cavity 6232 is defined in a right side of the back wall 623. The second clasping portion 6231 is similar to the first clasping portion 6221, and the second locating cavity 6232 is similar to the first locating cavity 6231.

The first part 61 is similar to the second part 62, therefore they can fully combined together, and detailed description of the first part 61 is omitted hereby. The insulated housing 1 is assembled with the first part 61 and the second part 62, with the back wall 15 is sandwiched between the supporter member 6200 of the second part 62 and a corresponding supporter member (not numbered) of the first part 61, the protrusion members 152 are accommodated in the slot 6202 of the second part 62 and a corresponding slot (not numbered) of the first part 61. The tail portions 23 of the contacts 2 are spaced apart each other by the ribs 6201.

Figure 6:
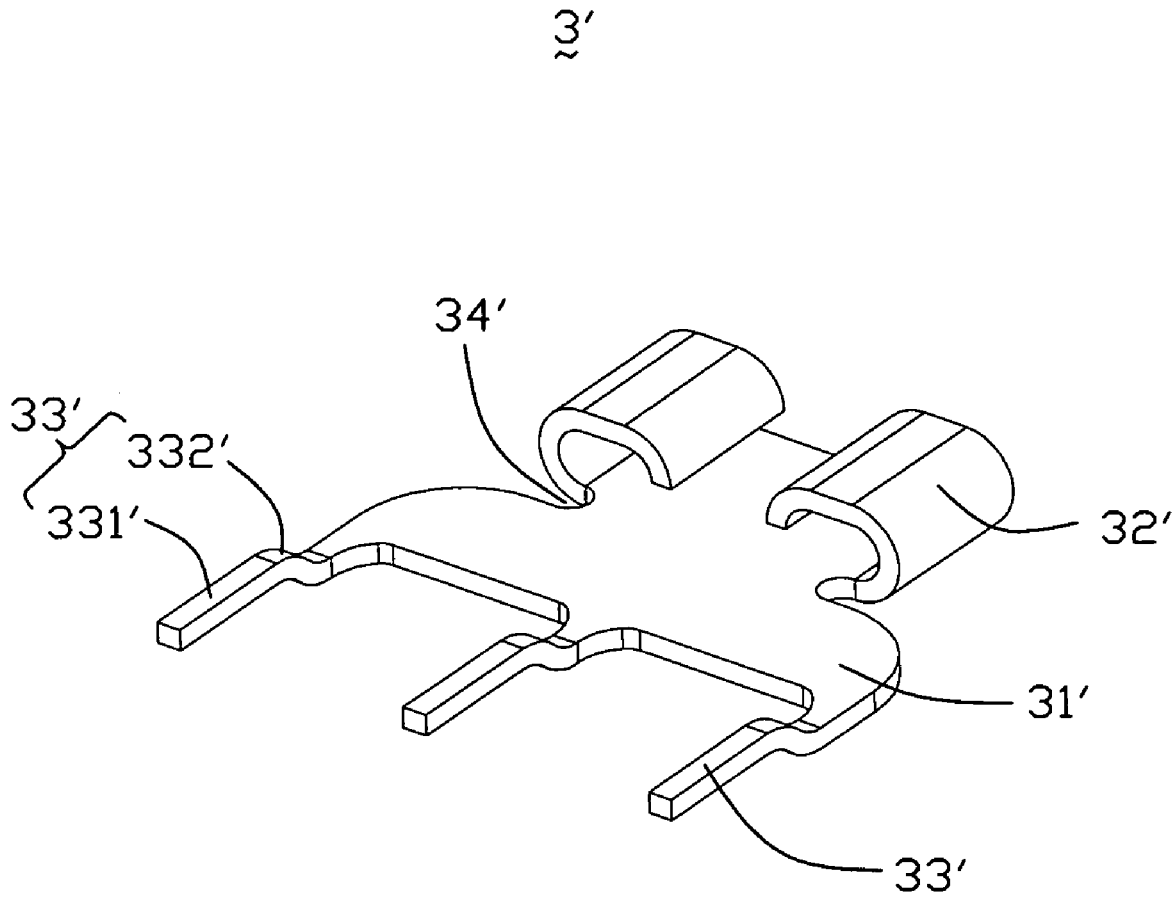
FIG. 6 is a grounding member of a cable assembly of a second embodiment in accordance with the present invention.
Figure 7:
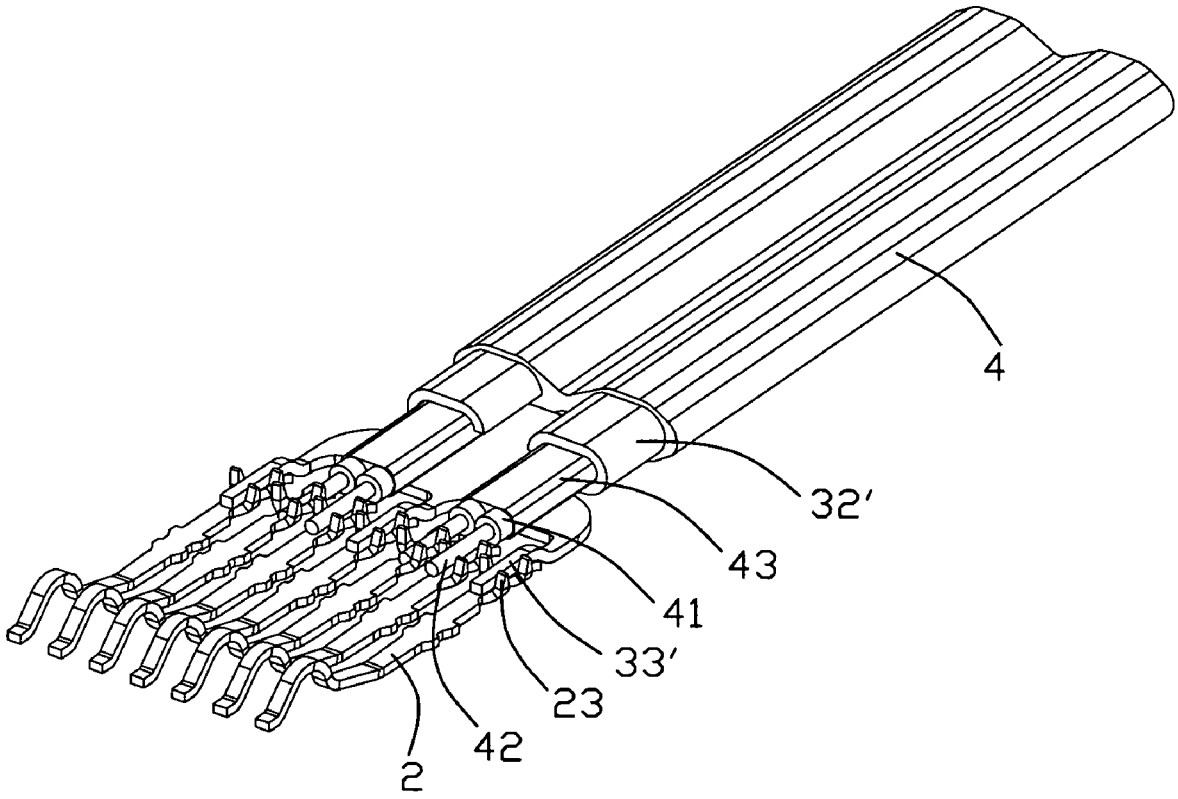
FIG. 7 illustrates interconnection relations between cables and contacts.

Please referring to FIGS. 6-7, illustrating partial elements of a second embodiment of the present invention. Compared with the first embodiment, the main difference is a grounding member 3' and the aforementioned grounding member 3. The identical elements and their relations of between the first and second embodiments are omitted hereby. The grounding member 3' is made of metallic sheet and comprises a main portion 31', three finger portions 33' spaced apart each other and projected forwardly from the main portion 31'. Two slits 34' are firstly defined in lateral sides of a middle segment of the main portion 31', and then two lateral portions of a rear segment of the main portion 31' are bent upwardly and inwardly to form two connecting portions 32'. Each finger portion 33' including an inclined transition portion 332' projecting forwardly and upwardly from the main portion 31' and a horizontal portion (front segment) 331' extending forwardly from the transitioning portion 332', thus the horizontal portion 331' is disposed higher than the main portion 31', such configuration facilitates terminating processing between the grounding member 3' and the contacts 2.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

The invention claimed is:

1. A cable assembly, comprising:

an insulated housing defining a plurality of contact slots;

a plurality of contacts accommodated in the contact slots, with tail portions thereof disposed outside of the insulated housing;

a cable including a conductive shielding portion and two wires enclosed within the conductive shielding portion;

a grounding member including a main portion, a finger portion extending forwardly from the main portion and a connecting portion formed at a rear segment of the main portion, said connecting portion gripping the conductive shielding portion of the cable; and the finger portions and inner conductors of the wires being clamped by the tail portions of the contacts.

2. The cable assembly as recited in claim 1, wherein a front segment of the finger portion is higher than the main portion of the grounding member.

3. The cable assembly as recited in claim 2, wherein a number of tooth-shaped protrusion members are alternately arranged at two lateral sides of the tail portion of each contact for clamping the corresponding finger portion or inner conductor.

4. The cable assembly as recited in claim 1, further comprising a cover to hold the insulated housing.

5. The cable assembly as recited in claim 4, wherein a plurality of protrusion members are formed on a rear portion of the insulated housing and received in slots defined in a front segment of an interior of the cover.

6. The cable assembly as recited in claim 5, wherein a plurality of ribs are disposed behind the slot, and the tail portions of contacts are spaced apart from each other by the ribs.

7. The cable assembly as recited in claim 4, wherein the cover includes two identical halves combined together via engaging means formed thereon.

8. A cable assembly, comprising:

an insulated housing extending along a front-to-back direction;

a plurality of contacts arranged in a row and supported by the insulated housing, said contacts including three grounding contact members spaced by two pairs of signal contact members;

a cable including two juxtaposed differential pairs respectively enclosed by conductive shielding portions;

a grounding member including a main portion and three finger portions extending forwardly therefrom and two juxtaposed connecting portions formed at lateral sides of a rear segment thereof; and said connecting portions respectively gripping the conductive shielding portions, the finger portions and inner conductors of the differential pairs being clamped by tail portions of the grounding contact members and tail portions of the signal contact members, respectively.

9. The cable assembly as recited in claim 8, wherein a number of tooth-shaped protrusion members are alternatively arranged at two lateral sides of the tail portion of each contact for clamping the corresponding finger portion or inner conductor.

10. The cable assembly as recited in claim 8, wherein front segments of the finger portions are disposed higher than the main portion.

11. The cable assembly as recited in claim 10, wherein the front segments of the finger portions and the inner conductors are arranged in a row and at a same level along a vertical direction.

12. The cable assembly as recited in claim 8, wherein two slits are respectively preformed between the connecting portions and the main portion of the grounding member.

13. An electrical cable connector comprising:

an insulative housing defining a plurality of passageways extending in a front-to-back direction;

a plurality of signal contacts received in the corresponding passageways, respectively;

a plurality of ground contacts received in the corresponding passageways, respectively; and a plurality of cables located behind the housing and including a plurality of inner conductors crimped by tails of the corresponding signal contacts, and a plurality of outer conductors respectively surrounding said inner conductors and crimped by a unitary grounding member; wherein said grounding member includes a plurality of fingers crimped by tails of the corresponding ground contacts, respectively.

14. The electrical cable connector as claimed in claim 13, wherein said grounding member includes a main body, of which a connection portion extends from a rear portion thereof to crimp the outer conductors, and said finger extends from a front portion thereof.

15. The electrical cable connector as claimed in claim 14, wherein said fingers are offset from the main body so as to be located at a same level with the inner conductors, whereby both said inner conductors and said fingers are compliant to the tails of the corresponding signal contacts and ground contacts for crimping.

* * * * *